US005996438A

United States Patent [19]

Elton

[11] Patent Number: 5,996,438

[45] Date of Patent: Dec. 7, 1999

[54] ADJUSTABLE ACCELERATOR PEDAL

[75] Inventor: Robert Douglas Elton, Ann Arbor, Mich.

[73] Assignee: General Motors Corporation, Detroit, Mich.

[21] Appl. No.: 09/103,013

[22] Filed: Jun. 23, 1998

[51] Int. Cl.[6] ..... G05G 1/14

[52] U.S. Cl. ..... 74/512; 74/513; 74/560

[58] Field of Search ..... 74/512, 513, 560, 74/522, 561, 562

[56] References Cited

U.S. PATENT DOCUMENTS

| | | | |
|---|---|---|---|
| 3,631,739 | 1/1972 | McArthur . | |
| 3,643,524 | 2/1972 | Herring . | |
| 3,643,525 | 2/1972 | Gibas . | |
| 3,828,625 | 8/1974 | Bruhn, Jr. . | |
| 3,975,972 | 8/1976 | Muhleck . | |
| 4,546,667 | 10/1985 | Bopst, III . | |
| 4,870,871 | 10/1989 | Ivan . | |
| 4,875,385 | 10/1989 | Sitrin . | |
| 4,989,474 | 2/1991 | Cicotte et al. | 74/512 |
| 5,010,782 | 4/1991 | Asano et al. . | |
| 5,056,742 | 10/1991 | Sakurai . | |
| 5,078,024 | 1/1992 | Cicotte et al. . | |
| 5,086,663 | 2/1992 | Asano et al. . | |
| 5,351,573 | 10/1994 | Cicotte . | |
| 5,460,061 | 10/1995 | Redding et al. . | |
| 5,497,677 | 3/1996 | Baumann et al. . | |
| 5,819,593 | 10/1998 | Rixon et al. | 74/514 |
| 5,832,784 | 11/1998 | McCallips et al. | 74/512 |
| 5,875,688 | 3/1999 | Porter et al. | 74/540 X |

*Primary Examiner*—Vinh T. Luong
*Attorney, Agent, or Firm*—Kathryn A. Marra

[57] ABSTRACT

An adjustable pedal mechanism for automotive vehicles includes a pedal lever with a pivot near its center between its ends. An upper end of the lever is connected with a throttle cable that extends through a conduit to an operated device, such as a throttle valve or other power control. A lower end of the lever carries a foot pedal engagable by a driver's foot to operate the pedal. The central pivot is carried in a bracket having a slot or other form of track along which the pivot is movable generally longitudinally of the vehicle. As the pivot is moved rearward along the slot, the pedal is moved closer to the driver. The slot is positioned or configured so that the height of the pedal remains constant or is slightly lowered as the pedal is moved rearward. If the vehicle is provided with an electronic throttle control, or similar device, the upper end of the lever may be omitted and a position controller may be mounted at or adjacent the location of the pivot. In either case, pedal adjustment may be powered by a screw driven by an electric motor through a cable and worm gear drive or other suitable means.

15 Claims, 3 Drawing Sheets

ADJUSTABLE ACCELERATOR PEDAL

TECHNICAL FIELD

This invention relates to adjustable pedals for vehicles and more particularly to an adjustable accelerator pedal mechanism with an extended range of adjustment travel.

BACKGROUND OF THE INVENTION

The majority of automotive vehicles currently available are provided with accelerator pedals and other operating pedals located in relatively fixed positions with a fixed extent of operating motion. They cannot be adjusted closer to or farther away from the driver. In general these pedals have shared the same operating axis as the fixed pedals. The adjusting system effectively lengthened or shortened the operating link between the pedal arm and the brake booster or the accelerator cable attachment.

If adjustment of the pedals is limited to the existing pedal axis, extensive rearward travel would cause the pedal to rise from the floor.

SUMMARY OF THE INVENTION

The present invention provides a solution to these problems by providing an adjustable pedal mechanism for automotive vehicles which utilizes a pedal lever with a pivot near its center between its ends. An upper end of the lever is connected with a throttle cable that extends through a conduit to an operated device, such as a throttle valve or other power control. A lower end of the lever carries a foot pedal engagable by a driver's foot to operate the pedal. The central pivot is carried in a bracket having a slot or other form of track along which the pivot is movable generally longitudinally of the vehicle. As the pivot is moved rearward along the slot, the pedal is moved closer to the driver. The slot is positioned or configured so that the height of the pedal remains constant or is slightly lowered as the pedal is moved rearward.

If the vehicle is provided with an electronic throttle control, or similar device, the upper end of the lever may be omitted and a position controller may be mounted at or adjacent the location of the pivot. In either case, pedal adjustment may be powered by a screw driven by an electric motor through a cable and worm gear drive or other suitable means.

These and other features and advantages of the invention will be more fully understood from the following description of certain specific embodiments of the invention taken together with the accompanying drawings.

DESCRIPTION OF THE PREFERRED EMBODIMENT

Figure 1:
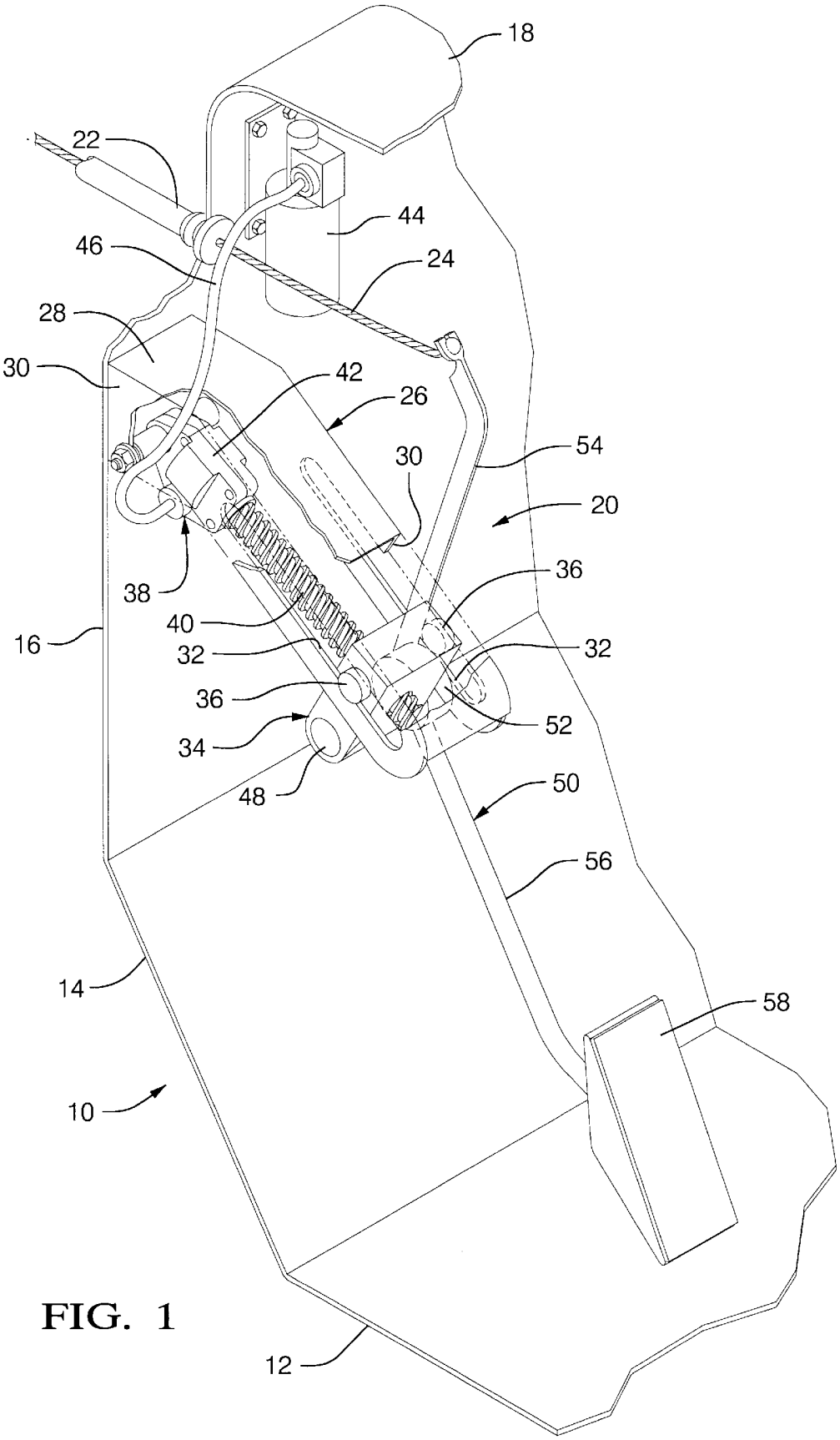
FIG. 1 is a fragmentary perspective view of an adjustable accelerator pedal mechanism according to the invention.

Referring now to the drawings in detail, numeral 10 generally indicates an automotive vehicle body having an enclosure including a floor 12, toe panel 14, dash panel 16, and an upper cowl panel 18. These portions of the body 10 enclose and support an adjustable pedal mechanism 20 to be subsequently described.

Figure 2:
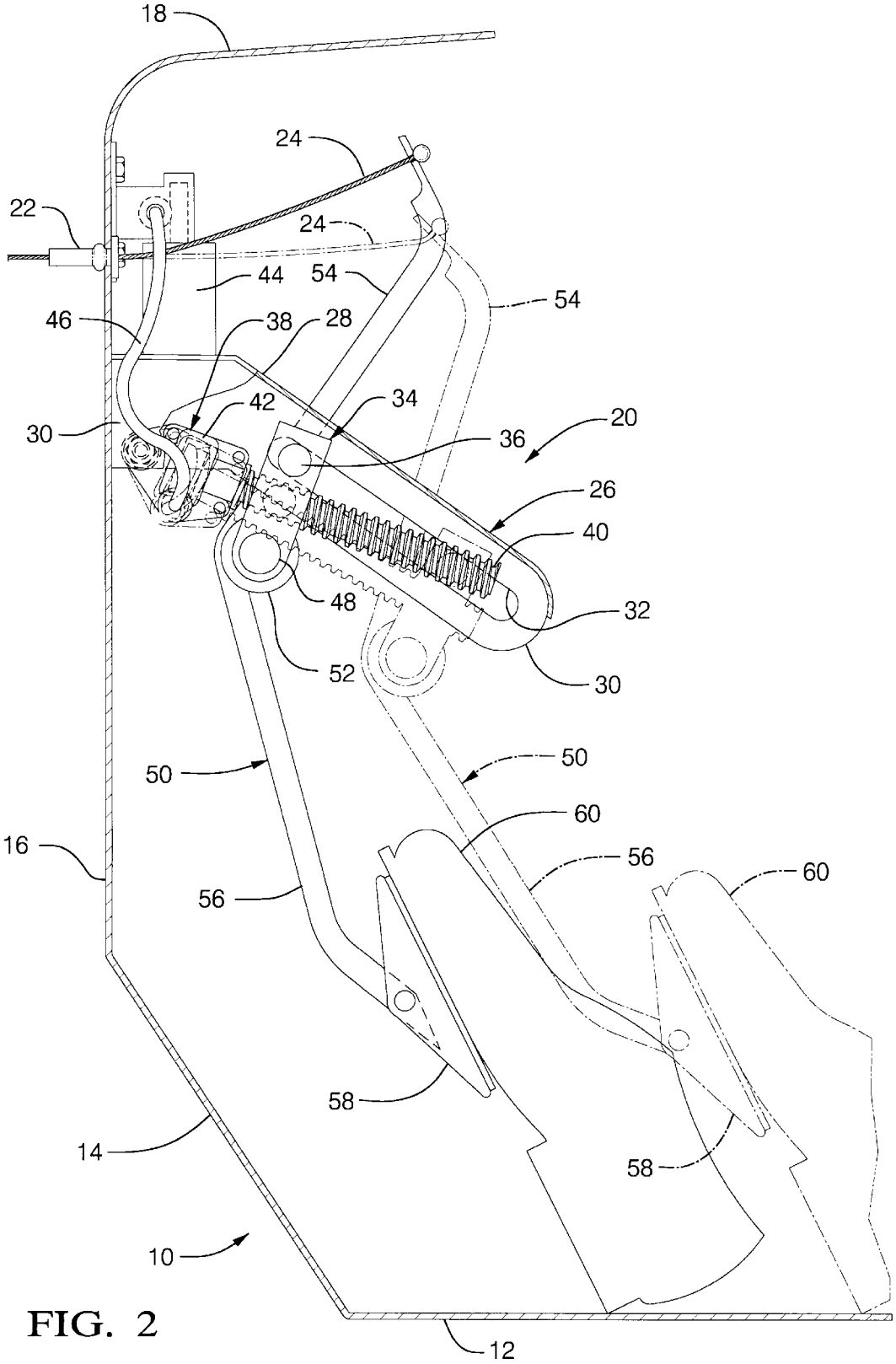
FIG. 2 is a side view illustrating the forward and rearward extreme positions of adjustment of the pedal mechanism of FIG. 1.

The dash panel 16, mounts a conduit 22 through which extends an accelerator cable 24 connected with a vehicle throttle or other power control means, not shown. FIGS. 1 and 2 of the drawings show the accelerator cable 24 in the idle position wherein it is slid to its farthest forward position within the conduit 22. Drawing FIG. 1 shows the pedal mechanism positioned near the rear limit of its adjustment range while FIG. 2 shows the full range of adjustment of the mechanism.

The adjustable pedal mechanism 20 includes a bracket 26 fixed to the dash panel 16 by welding or in any other suitable manner. Bracket 26 includes an upper wall 28 connecting with a pair of laterally spaced depending side walls 30. Rearwardly, the bracket 26 slopes downwardly toward its rear end and the side walls 30 include spaced parallel slots 32. The slots 32 extend generally longitudinally of the body 10 but, in the illustrated embodiment, slope linearly downward toward the rear of the bracket 26.

Between the side walls 30, the bracket 26 supports an adjusting nut 34 having a pin or a pair of circular slides 36 received and slidable in the slots 32. Nut 34 is movable within the slots 32 between forward and rear adjustment positions near the ends of the slots 32. Powered adjustment means are provided comprising an actuator 38 including a screw 40 threadably engaging the nut 34 and rotatably drivable by a worm drive 42 enclosed in a case pivotally mounted to the bracket 26. An electric actuator motor 44, which may be mounted in a convenient location such as under the cowl panel 18, actuates the worm drive 42 through a flexible cable 46.

The nut 34 also supports a pivot pin 48 which pivotally carries a pedal lever 50 at a mount 52 located between upper and lower arms 54, 56, respectively. The lower arm 56 has a lower end on which is mounted a foot pedal 58 for conventional foot actuation of the lever. The upper arm 54 has an upper end which is connected with the accelerator cable 24 for actuating the power control, not shown. Note that the upper and lower arms 54, 56 form an obtuse angle A (FIG. 3) at their pivot point in order to fit the mechanism within the working space behind the dash panel 16. This angle A and the positioning of the connected elements of the pedal mechanism 20 are factors affecting the configuration of the adjusting track defined by slots 32 needed to maintain the pedal height within a desired height limit with its range of adjustment.

FIG. 2 best illustrates the operation of mechanism 20 as pertains to its fore and aft adjustment by the actuator 38. The figure shows in solid lines the full forward position of the mechanism 20 wherein the nut 34 has been driven to its forward position and the foot pedal 58 is positioned at its closest point to the toe panel 14. Note that the pedal 58 is positioned at a convenient height above the floor to be easily accessible to a driver's foot indicated by numeral 60.

To adjust the position of the foot pedal 58 rearward, the actuator motor 44 is operated to rotate the screw 40, sliding the nut 34 rearward in the slots 32. This moves the pivot mount 48 rearward toward the rear position shown in dashed lines in FIG. 2. This causes the pedal lever 50 to be rotated counterclockwise as seen in FIG. 2 about the end of the accelerator cable 24 to which the upper end of the upper arm 54 is connected. The foot pedal 58 is thereby moved rearward toward its rear position shown in dashed lines in FIG. 2. During the rearward motion, the pedal 58 height above the floor 12 may be slightly reduced to maintain a suitable height.

Alternatively, the mechanism 20 may be configured to maintain the foot pedal 58 at an essentially constant height through its range of adjustment travel. This may be accomplished by varying the slope and curvature, if provided, of the slots 32 which form the track for the adjusting motion of the adjusting nut 34 and is affected by the positioning and shape of the pedal lever 50 and the location of its pivot between the upper and lower arms 54, 56 of the lever 50.

Figure 3:
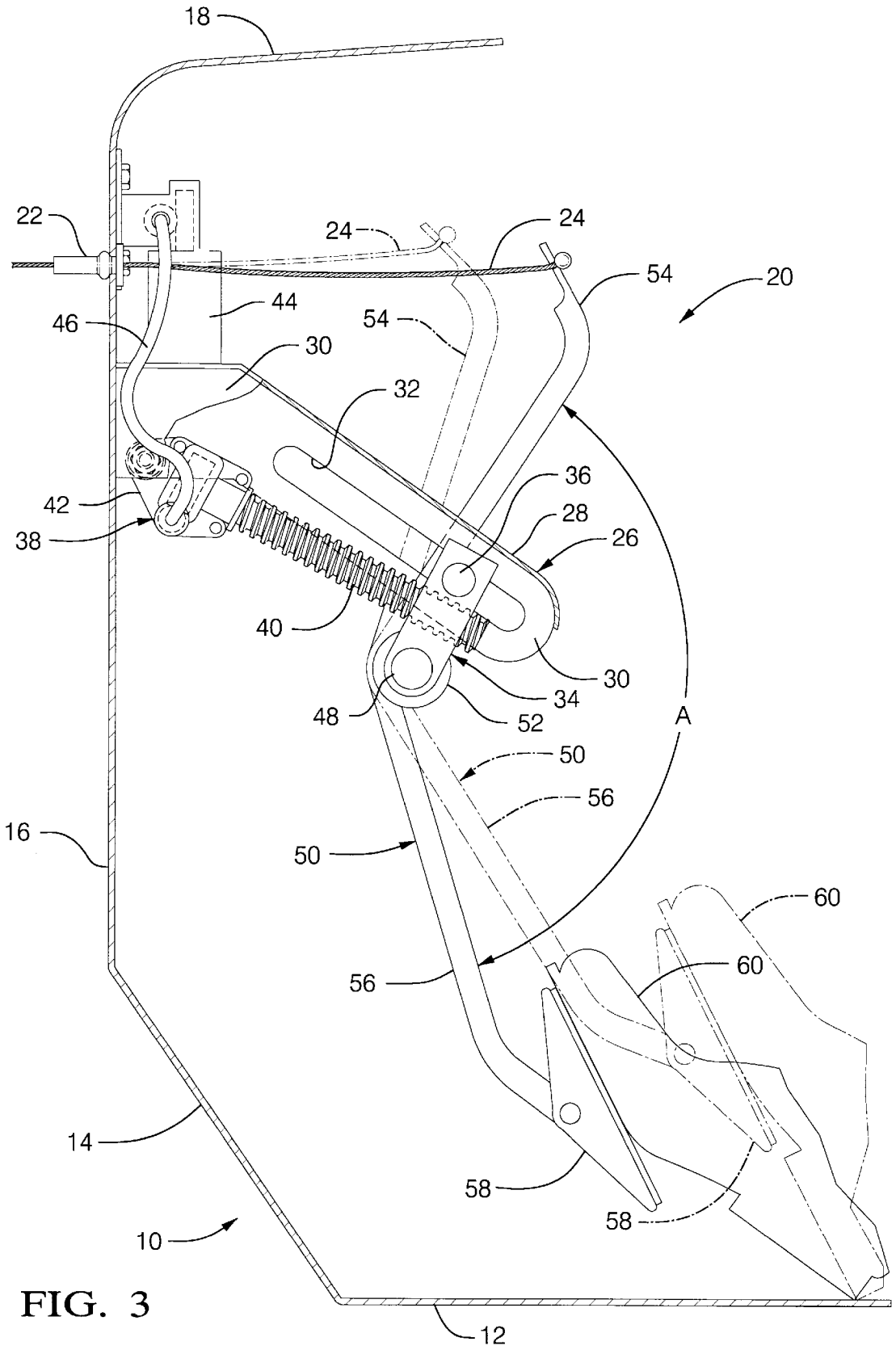
FIG. 3 is a view similar to FIG. 2 illustrating the actuating positions of the pedal in its rear position of operation.

FIG. 3 illustrates the operation of the adjustable pedal mechanism 20 in its movement of the throttle cable 24 between idle and full power positions as the driver's foot 60 presses forward on the foot pedal 58. The mechanism 20 is shown in solid lines in the full power position with the adjusting nut 34 moved to its full rearward adjustment position. Note that in this full power position, the pedal lever 50 is pivoted clockwise so that the throttle cable 24 is pulled rearward to its full power position and the foot pedal 58 is pushed forward to its full power position. As the driver's foot 60 is moved rearward, it reaches the idle position shown in phantom lines in FIG. 3. In this idle position, the pedal lever 46 has been pivoted counterclockwise, allowing springs, or other means not shown, connected with the vehicle power control, not shown, to return the accelerator cable 24 and the connected pedal lever 50 to the idle position.

Thus the mechanism of the current invention is shown to provide a relatively large range of fore and aft adjustment of the foot pedal without causing a significant change in the attitude or height of the foot pedal throughout the range of travel. There is thus provided an improved adjustable throttle pedal mechanism which provides for convenient adjustment of the pedal location to accommodate drivers of various leg lengths.

The mechanism 20 as described may also be used with minor modifications to adjust an accelerator pedal location for a vehicle having an electronic throttle control or similar control means. In this case, upper arm 54 of the pedal lever 50 may be deleted and the lever pivot mount be connected directly to a position sensor, not shown, that would send the pedal position to a throttle control system that would move the throttle accordingly. With such an arrangement, the actuator 38 could be combined with an actuator for a brake pedal, not shown, of the vehicle so that the adjusting movements of both pedals may be accomplished together by the single actuator.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

I claim:

1. An adjustable pedal mechanism in an automotive vehicle having a body, said mechanism comprising:

a support fixed to the body and including a track extending generally longitudinally of the vehicle;

an adjustable pivot movable along said track between forward and rear adjustment positions;

adjustment means separately connecting said pivot with said support and adjustable to selectively vary the position of the pivot between the forward and rear adjustment positions; and a pedal lever having upper and lower pedal arms and a mount intermediate said arms and mounted on said pivot, said lower arm mounting a foot pedal at a lower end thereof and said upper arm having an upper end engaging a power control element;

wherein actuation of the foot pedal forward rotates the pedal lever about the pivot, moving the power control element in a power increasing direction, relaxation of foot pressure on the foot pedal allowing return of the mechanism to an idle position, movement of the adjustment means along the track pivoting the pedal lever about the power control element to selectively position the foot pedal for actuating movement in any of a range of operating positions between forward and rear positions corresponding to the forward and rear adjustment positions of the pivot;

said arms extending at an angle and said track guiding the pivot along a path that coacts with said angle to maintain a limited variation in height of the foot pedal during adjustment between its forward and rear positions.

2. An adjustable pedal mechanism as in claim 1 wherein said track is configured to maintain an essentially constant height of the foot pedal.

3. An adjustable pedal mechanism as in claim 1 wherein said track is configured to slightly lower the height of the foot pedal during movement from the forward to the rear position.

4. An adjustable pedal mechanism as in claim 1 wherein said support is a bracket mounted on a wall of an associated body, and said track includes at least one slot in said bracket.

5. An adjustable pedal mechanism as in claim 4 wherein said pivot is carried by a nut retained in said slot and slidably movable therealong.

6. An adjustable pedal mechanism as in claim 5 wherein said adjustment means includes a screw engagable with said nut and pivotally connected with said bracket.

7. An adjustable pedal mechanism as in claim 6 and including driving means for rotating the screw, the driving means including a worm gear connected with the screw and mounted in a housing pivotally connected with said bracket and a drive motor operatively connected for rotating said gear.

8. An adjustable pedal mechanism as in claim 1 wherein said control element is a cable connectable through a conduit with a power control.

9. An adjustable pedal mechanism in an automotive vehicle having a body, said mechanism comprising:

a support fixed to the body and including a track extending generally longitudinally of the vehicle;

an adjustable pivot movable along said track between forward and rear adjustment positions;

adjustment means separately connecting said pivot with said support and adjustable to selectively vary the position of the pivot between the forward and rear adjustment positions; and a pedal lever having a lower pedal arm and a mount at an upper end of said arm and mounted on said pivot, said lower arm mounting a foot pedal at a lower end thereof and said upper end engaging a power control element;

wherein actuation of the foot pedal forward rotates the pedal lever about the pivot, moving the power control element in a power increasing direction, relaxation of foot pressure on the foot pedal allowing return of the pedal lever to an idle position, movement of the adjustment means along the track positioning the foot pedal for actuating movement in any of a range of operating positions between forward and rear positions corresponding to the forward and rear adjustment positions of the pivot;

said track guiding the pivot along a path that maintains a limited variation in height of the foot pedal during adjustment between its forward and rear positions.

10. An adjustable pedal mechanism as in claim 9 wherein said track is configured to maintain an essentially constant height of the foot pedal.

11. An adjustable pedal mechanism as in claim 9 wherein said track is configured to slightly lower the height of the foot pedal during movement from the forward to the rear position.

12. An adjustable pedal mechanism as in claim 9 wherein said support is a bracket mounted on a wall of an associated body, and said track includes at least one slot in said bracket.

13. An adjustable pedal mechanism as in claim 12 wherein said pivot is carried by a nut retained in said slot and slidably movable therealong.

14. An adjustable pedal mechanism as in claim 13 wherein said adjustment means includes a screw engagable with said nut and pivotally connected with said bracket.

15. An adjustable pedal mechanism as in claim 14 and including driving means for rotating the screw, the driving means including a worm gear connected with the screw and mounted in a housing pivotally connected with said bracket and a drive motor operatively connected for rotating said gear.

* * * * *